United States Patent [19]

Hammer et al.

[11] Patent Number: 4,644,227

[45] Date of Patent: Feb. 17, 1987

[54] THREE LAMP BALLAST

[75] Inventors: Edward E. Hammer, Mayfield Village; Eugene Lemmers, Cleveland Heights, both of Ohio; Dail L. Swanson, Danville, Ill.

[73] Assignee: General Electric Company, Schenectady, N.Y.

[21] Appl. No.: 684,311

[22] Filed: Dec. 20, 1984

Related U.S. Application Data

[63] Continuation-in-part of Ser. No. 573,991, Jan. 26, 1984.

[51] Int. Cl.[4] ..... H05B 39/00; H05B 41/14

[52] U.S. Cl. ..... 315/96; 315/185 R; 315/187; 315/278

[58] Field of Search ..... 315/95, 96, 97, 184, 315/185, 188, 187, 278

[56] References Cited

U.S. PATENT DOCUMENTS

| | | | |
|---|---|---|---|
| 3,080,503 | 3/1963 | Brooks | 315/99 X |
| 3,351,809 | 11/1967 | Eppert | 315/97 |
| 4,259,616 | 3/1981 | Smith | 315/DIG. 5 |
| 4,477,748 | 10/1984 | Grubbs | 315/307 |
| 4,525,649 | 6/1985 | Knoll et al. | 315/DIG. 5 |

*Primary Examiner*—Saxfield Chatmon

*Attorney, Agent, or Firm*—Nathan D. Herkamp; Philip L. Schlamp; Fred Jacob

[57] ABSTRACT

A low pressure gas discharge lamp ballast circuit is provided for three series-connected low energy gas discharge lamps, in which a first starting capacitor provides a starting voltage to one of the lamps, and a second starting capacitor provides a starting voltage to a second one of the lamps in sequence, so that the ballast losses can be minimized by reducing the ratio of the voltage applied across the three lamp system to the total lamp voltage, while still maintaining the light output and not having to use expensive lamp bases and lampholders.

39 Claims, 4 Drawing Figures

THREE LAMP BALLAST

CROSS-REFERENCE TO RELATED APPLICATIONS

This case is a continuation-in-part of application Ser. No. 573,991, filed Jan. 26, 1984.

BACKGROUND OF THE INVENTION

1. Field of the Invention

This invention relates to ballast circuits for gas discharge lamps, and, more particularly, to a ballast circuit for three series-connected, low pressure gas discharge lamps.

2. Description of the Prior Art

In designing lighting systems, a determination must be made of the amount of light necessary for a task or function to be performed within the area to be lighted. The type and number of lamps must be compatible with the quantity and quality of light required. In some applications, three gas discharge lamps are employed in a three lamp fixture to provide the required lighting. Gas discharge lamps, for example, fluorescent lamps, require a ballast circuit to control the electrical power supplied to each of the lamps. A difficulty with the prior art three lamp fixtures is that no energy efficient three lamp ballast is available to supply all three lamps from a single ballast.

A prior art three lamp ballast is shown schematically in FIG. 3. A transformer 110 having a primary winding 112 connected to a power line providing 120-volt 60 Hertz a.c. power and a secondary winding 114 supplies a.c. power to power capacitor 116. A discharge resistor 118 is connected across capacitor 116 as a safety measure. A starting capacitor 120 with a parallel-connected discharge resistor 122 is connected to the output side 119 of capacitor 116. Preheating windings 124, 126, 128 and 130 are connected to electrodes disposed within the respective ends of conventional 40-watt lamps 132, 134 and 136. The starting capacitor 120 is connected to one terminal between electrodes of lamps 132 and 134.

The prior art circuit of FIG. 3 operates as follows. Electrical power is applied to the input terminals of transformer primary winding 112. Preheat current is supplied to the preheat windings 124, 126, 128 and 130. Starting power is applied at terminals 119 and 138 to series-connected lamps 132, 134 and 136 and to starting capacitor 120. Capacitor 120 allows current to substantially bypass lamp 132. The voltage and current applied to lamps 134 and 136 causes a glow due to partial ionization of the discharge gas in the lamps. The partial ionization and the large voltage from the power supply circuit causes ignition of lamps 134 and 136 which drops the voltage across the lamps 134 and 136 and imposes a starting voltage on lamp 132. The open circuit voltage across terminals 119 and 138 was approximately 445 volts. The lamp voltage was in the range of 100 volts for each lamp. Therefore, the ratio of open circuit voltage to total lamp voltage was approximately 1.5. The efficacy of the system was calculated to be approximately 60.1 lumens per watt (LPW). This overall system efficacy is not as high as that of conventional two lamp systems. Further, the high open circuit voltage represents some hazard to personnel or surrounding equipment, and is not the voltage level normally used in power distribution. In order to limit the hazard of high voltage, recessed contact or interrupting lampholders, which disable the lamp circuit whenever a lamp is removed, are used. This adds cost and complexity to the lamp system.

Another prior art approach to three lamp fixtures typically employs a two lamp ballast and a relatively inefficient one lamp ballast in the same fixture to provide two distinct power supply circuits, one supplying a pair of the lamps and the other supplying the remaining lamp of the three lamp set. This two lamp ballast and one lamp ballast combination approach circumvents the need for recessed contact or interrupting lampholders which are substantially more expensive to buy and install than the standard bipin lamp base and lampholders. Each ballast exhibits its operating characteristics including losses from its own secondary winding or isolated transformer in the power supply circuit. By requiring two ballasts, the overall efficacy in lumens of light output per watt of energy input is diminished by the losses associated with using two ballasts. One reason for employing two ballasts in a single fixture was to limit the power supply voltage to a pre-established level. The prior art recognized a required minimum voltage of 395 volts RMS to start three lamps connected in series. This high voltage requirement creates difficulty in meeting safety standards required for gas discharge lighting systems. Therefore, the prior art approach has been to limit each ballast circuit to one or two lamps in order to limit the required lamp starting voltage.

SUMMARY OF THE INVENTION

An object of the present invention is to provide a ballast circuit for operating three series-connected gas discharge lamps without requiring the use of recessed lamp bases and lampholders.

A more specific object of the present invention is to provide a ballast circuit for operating low energy, gas discharge lamps including a single autotransformer and a pair of separate starting means for the series-connected lamps in order to allow sequential starting of three lamps from a relatively low voltage power supply having a ratio of open circuit voltage to lamp voltage not exceeding 1.25.

Accordingly, the present invention comprises a ballast circuit for low energy, rapid start lamps including an autotransformer, a power capacitor connected in series with the output of the autotransformer, a plurality of lamp terminals for connecting gas discharge lamps in electrical series, a first starting capacitor connected across a first combination of lamp terminals to bypass a pair of the lamps during starting, and a second starting capacitor connected across a second combination of lamp terminals to bypass one of the lamps of the pair of lamps. In a particularly preferred embodiment of the present invention, the first starting capacitor connected across the pair of lamps has a value of capacitance less than the value of capacitance of the second starting capacitor.

BRIEF DESCRIPTION OF THE DRAWINGS

Further objects and advantages of the present invention together with its organization, method of operation and best mode contemplated may best be understood by reference to the following description taken in conjunction with the accompanying drawings, in which like reference characters refer to like elements throughout, and, in which.

DESCRIPTION OF THE PREFERRED EMBODIMENTS

Figure 1:
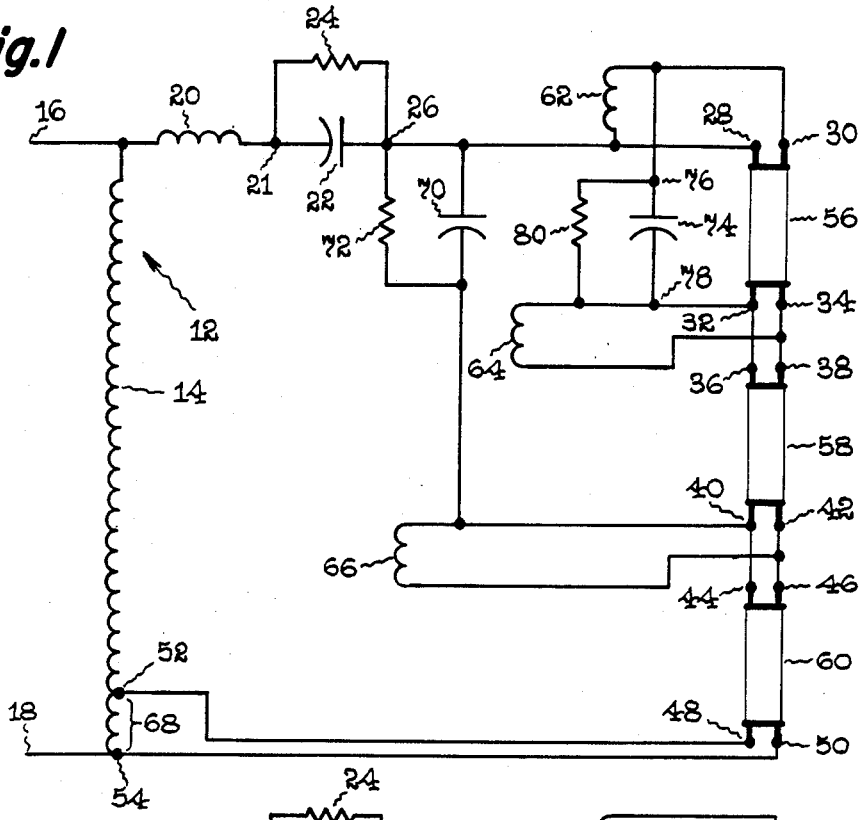
FIG. 1 is a schematic circuit diagram illustrating one embodiment of the ballast circuit of the present invention.

A schematic circuit diagram illustrating the present invention is shown in FIG. 1. An autotransformer 12 includes primary winding 14 having terminals 16 and 18 for connection to an outside power line, for example, a 120-volt a.c. 60 Hz line. With appropriate modifications, the input can be connected to a 277-volt 60 Hertz system. The transformer 12 further includes secondary winding 20 connected in electrical series with the primary winding 14. Connected in series with the secondary winding 20 is a power capacitor 22 for controlling the power factor and current level of the output from the autotransformer having a parallel-connected discharge resistor 24 connected thereto. A terminal 28 of a pair of terminals 28, 30 for connection to a first one of a plurality of gas discharge lamps is connected to the output terminal 26 of capacitor 22. A pair of terminals 32, 34 is connected in electrical parallel with a pair of terminals 36, 38, and a pair of terminals 40, 42 is connected in electrical parallel with respective ones of the terminals 44, 46. Terminals 48, 50 are connected to the autotransformer 12 as shown at 52 and 54. When low energy, rapid start type lamps 56, 58 and 60 are disposed in contact with the respective pairs of electrical contacts, the lamps are connected in electrical series between terminals 26 and 54. Auxiliary windings 62, 64 and 66 may be coupled to primary winding 14 or may be coupled to an auxiliary source. Windings 62, 64, 66 and 68 provide three sets of parallel-connected terminals for connection to the gas discharge lamps. Auxiliary heating winding 62 provides preheat current to the terminals 28, 30 for heating an electrode at one end of lamp 56. Auxiliary winding 64 provides preheating current to the terminals 32, 34 and 36, 38 for preheating the electrodes disposed in electrical parallel within the respective lamps 56 and 58, and auxiliary winding 66 provides preheating current to terminals 40, 42 and 44, 46 for preheating electrodes disposed within the respective ends of lamps 58 and 60. The connection to the winding at 52 and 54 of terminals 48 and 50 provides preheating current to the electrode disposed at the respective end of lamp 60. Also connected to terminal point 26 is a starting capacitor 70 having a discharge resistor 72 connected in parallel therewith and having its other side connected to terminal 44 of lamp 60. Connected across lamp 56 is starting capacitor 74 having one terminal 76 thereof connected to terminal 30 and the other terminal 78 thereof connected to terminal 32. Discharge resistor 80 is connected across starting capacitor 74. The lamps are of the low energy, rapid start type preferably containing a fill gas comprising mercury and a mixture of krypton and argon gases in a volume ratio of about 80% krypton to 20% argon at a fill pressure of the inert gas mixture in the range of 1.0–2.5 torr. Other inert gases such as neon may be used in place of the argon gas. Low energy lamps which contain the above gas mixture operate at lower wattage than conventional lamps of equivalent size with essentially equivalent light output.

The ballast circuit of the present invention operates as follows. A.C. power is supplied to the primary winding 14. An a.c. power output signal is provided from secondary winding 20 to power capacitor 22. Upon receiving a signal from capacitor 22, starting capacitor 70 provides a potential to terminal 44 of lamp 60 causing partial ionization of the discharge gas and low level current flow to cause lamp 60 to glow. At this time, the starting capacitor 74 applies a potential to lamp 58 causing it to glow. After lamps 58 and 60 glow, the voltage across capacitor 74 increases such that it causes lamp 56 to glow. When all three lamps 56, 58, 60 are glowing, the voltage across all three lamps measured from point 28 to point 50 of FIG. 1 is high enough to cause the lamps to fully start. In this fashion all of the series-connected lamps are started, and after the voltage is stabilized, the current flow through the capacitors 70 and 74 is reduced to a small current value relative to current flow through the lamps. Therefore, the current flow through each of the lamps and the illumination of each of the lamps are virtually identical.

In one embodiment of the present invention, the lamps used were 34-watt T12 lamps, 48" long. The results of two tests, one using input voltage of 120 volts and the other using input voltage of 277 volts, are shown in Table I.

TABLE I

| Parameter | 3 Lamp 120 Volt | 3 Lamp 277 Volt |
|---|---|---|
| Input Characteristics | | |
| Voltage | 120 | 277 |
| Power | 104 | 106 |
| Current | .875 | .390 |
| Power Factor | .99 | .98 |
| Lamp Values | | |
| Current | .395 | .395 |
| % Light Output | 90 | 90 |
| Crest Factor | 1.70 | 1.70 |
| Voltage | 80 | 80 |
| Capacitor Measurements | | |
| Power Section (22) | | |
| Microfarads | 4.1 | 4.1 |
| Voltage | 250 | 251 |
| Start Sections (70, 74) | | |
| Microfarads | .15/.15 | .15/.15 |
| Voltage | 84/165 | 84/165 |
| Open Circuit Voltage | | |
| Nominal | 290 | 288 |
| Output Values | | |
| Lumens | 7898 | 7898 |
| Lumens/Watt | 75.9 | 74.5 |
| Voltage Ratio | | |
| Nominal Open Circuit vs. Total Lamp Voltage | 1.21 | 1.20 |

A particularly advantageous circuit is realized by selecting the capacitance value of the first starting capacitor connected electrically across two of the series-connected lamps to be less than the capacitance value of the starting capacitor connected across a single one of the series-connected lamps; for example, capacitor 70 has a lower capacitance value than capacitor 74 of FIG. 1. With a capacitance value of the first starting capacitor, e.g. 70, in the range of one-third to three-fourths of the capacitance value of the second starting capacitor, e.g. 74, the life of the lamp first ionized, lamp 60 in FIG. 1, is extended due to the increase in reactive impedance of the capacitor branch of the circuit, which causes a reduction in the peak current level applied to the lamp which produces a reduction in sputtering of the lamp electrodes prior to starting. For the circuit shown in FIG. 1, a preferred range of capacitance values for capacitor 70 is about 0.10 to about 0.20 microfarad with a preferred range of values for capacitor 74 of from about 0.15 to about 0.30 microfarad. Tests have shown the improvement to be especially pronounced when the capacitance value of the first starting capacitor is approximately two-thirds of the capacitance value of the second starting capacitor. For example, by choosing a capacitor 70 of 0.10 microfarad and a capacitor 74 of 0.15 microfarad, an appreciable improvement in lamp life of lamp 60 is attained.

In the present invention, the open circuit secondary voltage appearing across the terminals 26 and 54 will be in the range of 265 to 300 volts RMS. If a 277-volt power supply is to be used, the taps 52 and 54 will be located on the primary winding so that the secondary voltage remains within the range of 265 to 300 volts RMS. As will be appreciated by those skilled in the art, these input voltage levels are substantially below that required for conventional lamps, and the nominal open circuit voltage is well below the 395-volt minimum level normally considered to be required to start three series-connected lamps. This is due to the use of low energy lamps and starting capacitors of 0.10–0.30 microfarad, as compared with prior art starting capacitors with nominal values of 0.075 microfarad, in the circuit as shown in FIG. 1. The voltage ratios of 1.21 and 1.20 in Table I are determinedd by dividing the nominal open circuit voltages, 290 and 288 volts, respectively, by the sum of the three lamp voltages, i.e., 240 volts, and are significantly below that achieved by any prior art three lamp ballast circuit. The same ballast circuit will provide starting and operating power to a three lamp fixture using three 48" long, 34–35 watt T12 lamps or 28-watt T12 lamps. The use of the large starting capacitors having 0.10–0.30 microfarad lowers the starting voltage required and system operating power by reducing the system impedance, which together with the low energy lamps allows the greatly reduced secondary circuit voltage between points 21 and 54 to be able to start three series-connected lamps with a single autotransformer ballast. Another advantage of the large starting capacitors 70 and 74 is that they modify the capacitive reactance of the lamp circuit during normal operation, so that a lower input wattage can be used than would be required with smaller capacitors. The lower secondary circuit voltage operation allows cooler operation of the ballast and therefore longer life of the system components. Furthermore, due to the fact that only a single transformer ballast circuit is required, the losses from the ballast circuit are limited to those inherent in a single autotransformer ballast circuit rather than in two ballast circuits as were used in one prior art approach as described above. This allows the high efficacy values of 75.9 LPW and 74.5 LPW shown in Table I to be achieved.

Figure 2:
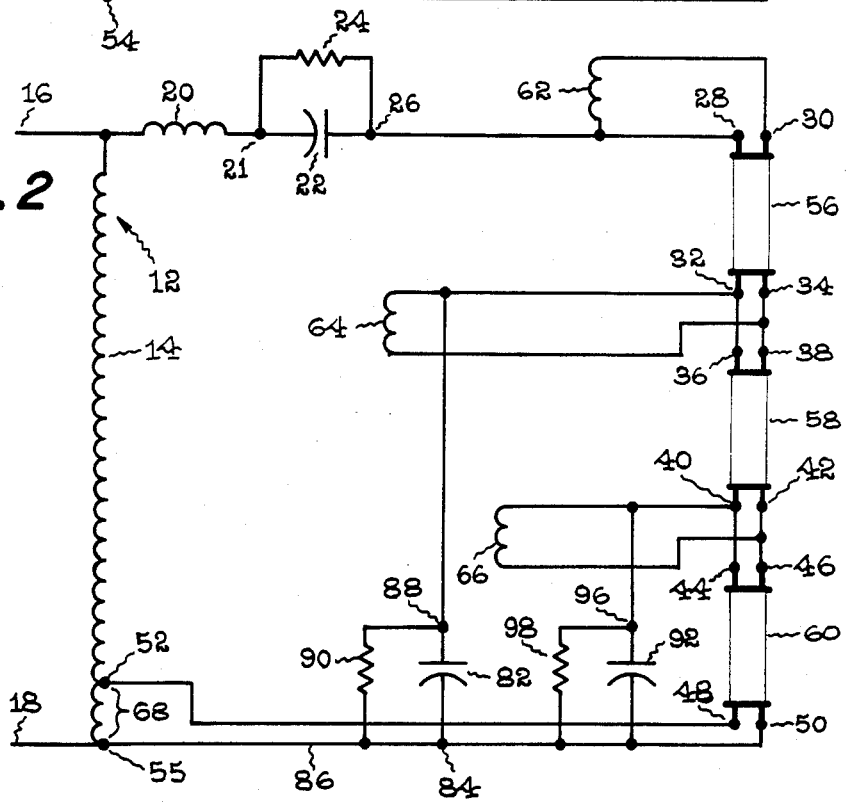
FIG. 2 is a schematic circuit diagram illustrating an alternative embodiment of the ballast circuit of the present invention.
Figure 3:
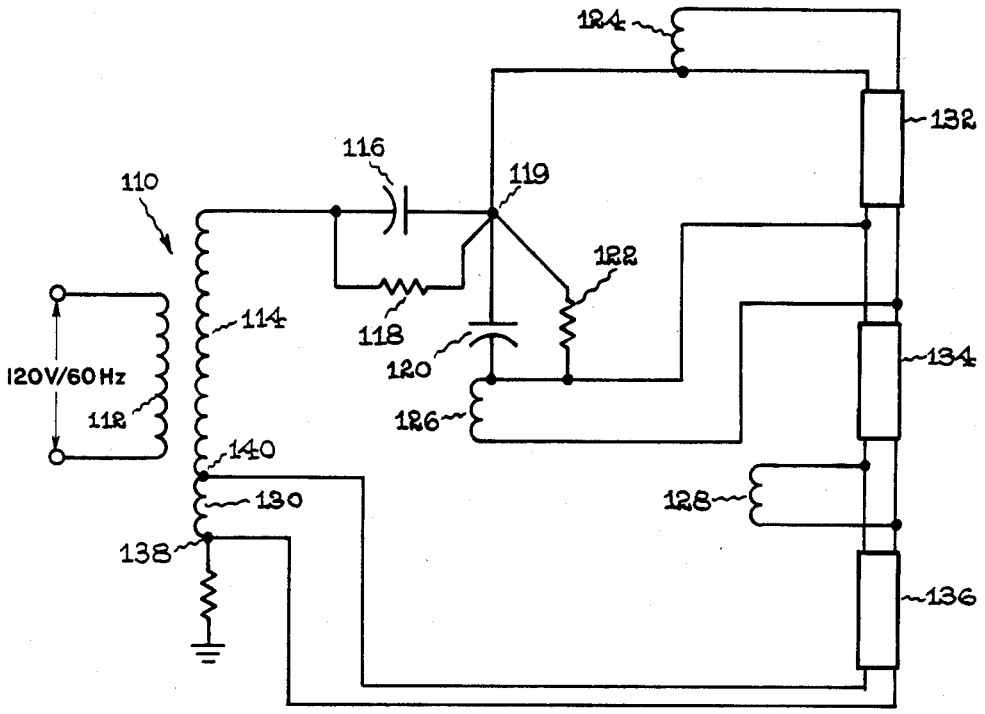
Fig.3 (PRIOR ART)
FIG. 3 is a schematic circuit diagram illustrating a prior art three-lamp ballast circuit.

An alternative embodiment of the present invention is illustrated schematically in FIG. 2 in which elements identical to those of FIG. 1 are shown with identical reference characters. A first starting capacitor 82 is shown having one terminal thereof, 84, connected to line 86 and the other terminal thereof, 88, connected electrically in series with terminal 32 for connection with lamp 56. A discharge resistor 90 is connected across capacitor 82. A second starting capacitor 92 has terminal 94 connected to line 86 and terminal 96 connected electrically in series with terminal 40 of lamp 58. A discharge resistor 98 is connected across the starting capacitor 92.

The embodiment shown in FIG. 2 operates as follows. Upon application of electrical power, the preheating windings 62, 64, 66 and 68 provide preheating electrical power to the respective electrodes of the lamps. The power applied to the secondary circuit is first applied via starting capacitor 82 to the lamp 56 to cause the lamp to glow, and thereafter the ballast circuit provides power via capacitor 92 to the lamp 58 to cause the lamp 58 to glow. After the lamps 56 and 58 are partially ionized, a large enough voltage will be created across capacitor 92 and lamp 60 to cause the lamp 60 to glow. With all the lamps thus partially ionized, the voltage across points 26 and 55 is sufficient to cause the lamps to transition to arc, i.e., start. The lamps then operate as described above relative to FIG. 1. Another alternative embodiment of the present invention is illustrated schematically in FIG. 4 in which elements identical to those of FIG. 1 are shown with identical reference characters. A first starting capacitor 70 is shown connected across two lamps 56 and 58. A second starting capacitor 100 has terminal 102 connected to lamp terminal 36 of lamp 58 and terminal 104 connected to terminal 40 of lamp 58. A discharge resistor 106 is connected across the starting capacitor 100. Capacitor 70 could be connected between terminals 48 and 36, while capacitor 100 remains connected as shown in FIG. 4 with equal effectiveness.

The embodiment shown in FIG. 4 operates as follows. Upon application of electrical power, the preheating windings 62, 64, 66 and 68 provide preheating electrical power to the respective electrodes of the lamps. The power applied to the secondary circuit is first applied via starting capacitor 70 to the lamp 60 to cause the lamp to glow, and thereafter the ballast circuit provides power via capacitor 100 to the lamp 56 to cause the lamp 56 to glow. After the lamps 60 and 56 are partially ionized, a large enough voltage will be created across capacitor 100 and lamp 58 to cause the lamp 58 to glow. With all the lamps thus partially ionized, the voltage across points 26 and 54 is sufficient to cause the lamps to transition to arc, i.e., start. The lamps then operate as described above relative to FIG. 1.

Figure 4:
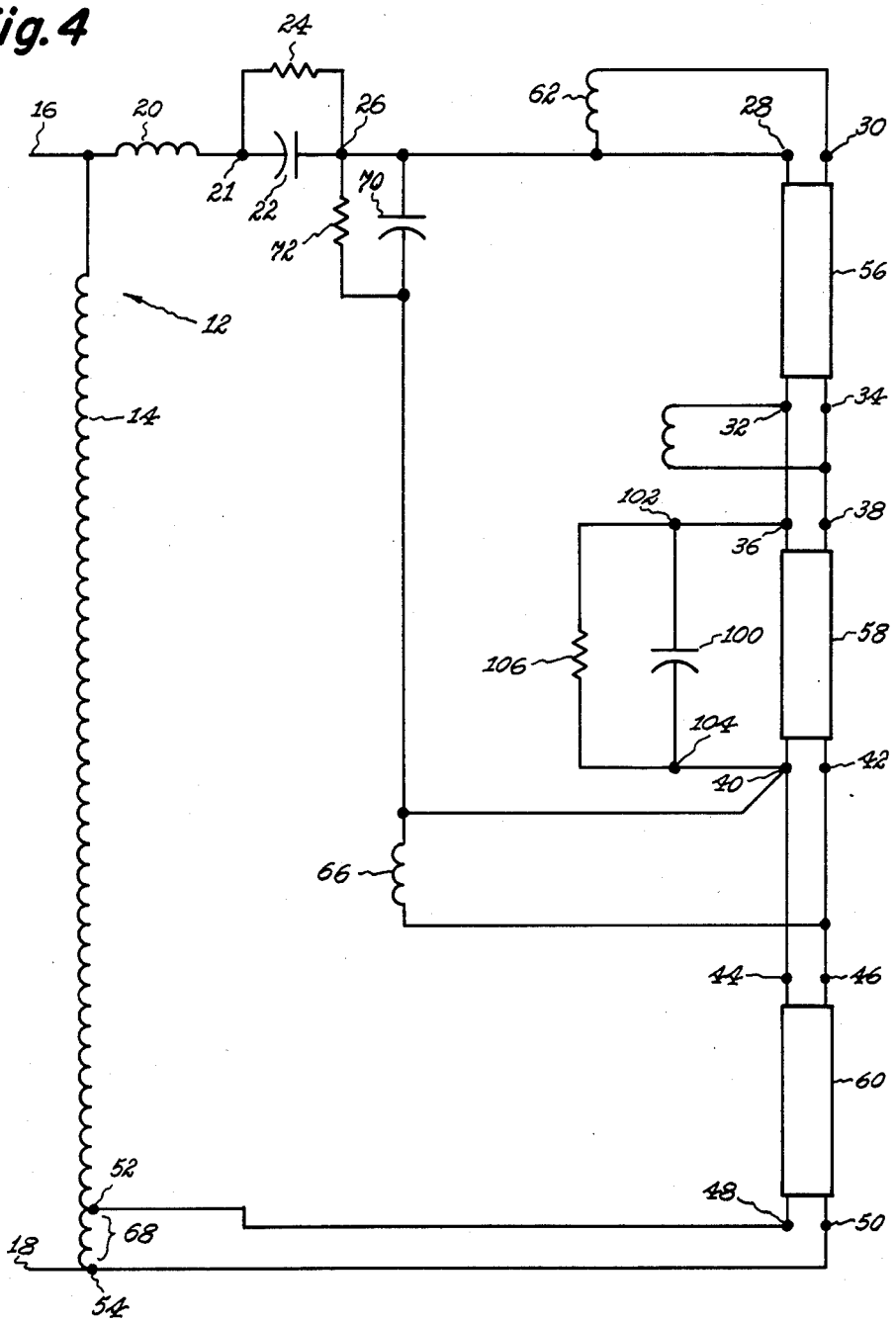
FIG. 4 is a schematic circuit diagram illustrating an alternative embodiment of the ballast circuit of the present invention.

The preferred range of values for capacitors 82 and 70 of FIGS. 2 and 4, respectively, is from about 0.10 to about 0.20 microfarad, and the preferred range for capacitors 92 and 100 is from about 0.15 to about 0.30 microfarad with the two capacitors 82 and 92 or 70 and 100, respectively, selected, such that the value of the first capacitor 82 or 70 is in the range of one-third to three-fourths of the value of capacitors 92 or 100, respectively. Each of the alternative circuit configurations achieves the improved result of starting and operating three series-connected low energy lamps without interrupting or recessed lampholders and with the voltage ratio between open circuit voltage and total lamp voltage of not more than about 1.25.

As will be appreciated by those skilled in the art, the present invention provides an efficient, reliable three low energy lamp ballast circuit which is fully compatible with conventionally available power supplies.

What we claim as new and desire to secure by Letters Patent of the United States is:

1. A ballast circuit for operating three low energy, rapid start gas discharge lamps comprising:

autotransformer means comprising primary winding means having a pair of input terminal means for connection to a source of a.c. power and having a first secondary circuit output terminal connected thereto and secondary winding means connected to said primary winding means and having a second secondary circuit output terminal connected thereto for converting an input electrical a.c. power signal of a first predetermined voltage received at said pair of input terminal means to an output secondary circuit electrical a.c. signal of a second predetermined open circuit voltage output at said first and second secondary circuit output terminals;

power capacitor means for controlling the power factor and current level of said output signal;

a plurality of sets of lamp terminal means for connecting respective ones of said three low energy, gas discharge lamps each having a predetermined operating voltage in electrical series with said power capacitor means;

first starting capacitor means connected to respective ones of said terminal means for bypassing a combination of a first one of said sets of lamp terminal means and a second one of said sets of lamp terminal means;

second starting capacitor means connected to respective ones of said terminal means for bypassing one of said first or said second sets of lamp terminal means; and wherein the ratio of said second predetermined open circuit voltage to the sum of the lamp operative voltages of said three low energy, gas discharge lamps is less than 1.25.

2. The invention of claim 1 wherein:

said second predetermined open circuit voltage is in the range of about 265 to about 300 volts RMS; and said total lamp operating voltage is approximately 240 volts RMS.

3. The invention of claim 2 wherein:

said first starting capacitor means has a capacitance value less than the capacitance value of said second starting capacitor means.

4. The invention of claim 3 wherein:

said first starting capacitor means comprises a first capacitor having a first predetermined capacitance value;

said second starting capacitor means comprises a second capacitor having a second predetermined capacitance value; and said first predetermined capacitance value is in the range of about one-third to about three-fourths of said second predetermined capacitance value.

5. The invention of claim 1 wherein said power capacitor means comprises:

a power capacitor having one terminal thereof connected to said second secondary circuit output terminal and the other terminal of said power capacitor connected electrically to a selected one of said lamp terminal means.

6. The invention of claim 5 wherein said plurality of sets of lamp terminal means comprises:

a first set of lamp terminal means comprising two pairs of lamp terminals for connection respectively to cathodes disposed at the respective ends of a first one of said lamps; a first terminal of a first pair of said terminals being connected to said other terminal of said power capacitor;

a second set of lamp terminal means comprising two pairs of lamp terminals for connection respectively to cathodes disposed at the respective ends of a second one of said lamps; a selected first pair of said terminals of said second set being connected electrically to respective ones of a second pair of terminals of said first set; and a third set of lamp terminal means comprising two pairs of lamp terminals for connection respectively to cathodes disposed at the respective ends of a third one of said lamps; a selected first pair of said terminals of said third set being connected electrically to respective ones of a second pair of terminals of said second set and a selected terminal of a second pair of said terminals of said third set being connected electrically to said first secondary circuit output terminal.

7. The invention of claim 6 wherein:

said first starting capacitor means comprises a starting capacitor having one terminal thereof connected to a selected terminal of said first pair of terminals of said first set of terminals and having the other terminal of said first starting capacitor connected to a selected one of said second pair of terminals of said second set of terminals; and said second starting capacitor means comprises a starting capacitor having one terminal thereof connected to said selected terminal of said first pair of terminals of said first set of terminals and having the other terminal of said second starting capacitor connected to a selected one of said second pair of terminals of said first set of terminals.

8. The invention of claim 7 wherein:

said first starting capacitor means comprises a first capacitor having a first predetermined capacitance value;

said second starting capacitor means comprises a second capacitor having a second predetermined capacitance value; and said first predetermined capacitance value is in the range of about one-third to about three-fourths of said second predetermined capacitance value.

9. The invention of claim 8 wherein:

the ratio of said second predetermined open circuit voltage across said first and second secondary circuit output terminals to the total lamp operating voltage of three low energy, gas discharge lamps is in the range of about 1.10 to about 1.25.

10. The invention of claim 9 further comprising:

cathode heating means for supplying preheat current to respective cathodes of respective ones of said lamps.

11. The invention of claim 10 wherein:

said second predetermined open circuit voltage is in the range of about 265 to about 300 volts RMS; and said total lamp operating voltage is approximately 240 volts RMS.

12. The invention of claim 11 further comprising:

a first discharge resistor means connected across said power capacitor means; and second and third discharge resistor means connected respectively across said first and second starting capacitor means.

13. The invention of claim 6 wherein:

said first starting capacitor means comprises a starting capacitor having one terminal thereof connected to a selected terminal of said second pair of terminals of said third set of terminals and having the other terminal of said first starting capacitor connected to a selected one of said first pair of terminals of said second set of terminals; and said second starting capacitor means comprises a starting capacitor having one terminal thereof connected to said selected terminal of said second pair of terminals of said third set of terminals and having the other terminal of said second starting capacitor connected to a selected one of said first pair of terminals of said third set of terminals.

14. The invention of claim 13 wherein:

said first starting capacitor means comprises a first capacitor having a first predetermined capacitance value; said second starting capacitor means comprises a second capacitor having a second predetermined capacitance value; and said first predetermined capacitance value is in the range of about one-third to about three-fourths of said second predetermined capacitance value.

15. The invention of claim 14 wherein:

the ratio of said second predetermined open circuit voltage across said first and second secondary circuit output terminals to the total lamp operating voltage of three low energy, gas discharge lamps is in the range of about 1.10 to about 1.25.

16. The invention of claim 15 further comprising:

cathode heating means for supplying preheat current to respective cathodes of respective ones of said lamps.

17. The invention of claim 16 wherein:

said second predetermined open circuit voltage is in the range of about 265 to about 300 volts RMS; and said total lamp operating voltage is approximately 240 volts RMS.

18. The invention of claim 17 further comprising:

first discharge resistor means connected across said power capacitor; and second and third discharge resistor means connected respectively across said first and second starting capacitor means.

19. The invention of claim 4 wherein:

said first starting capacitor means comprises a capacitor having a capacitance value in the range of about 0.10 to about 0.20 microfarad; and said second starting capacitor means comprises a capacitor having a capacitance value in the range of about 0.15 to about 0.30 microfarad.

20. The invention of claim 19 wherein:

said first starting capacitor means comprises a capacitor having a capacitance value of about 0.10 microfarad; and said second starting capacitor means comprises a capacitor having a capacitance value of about 0.15 microfarad.

21. The invention of claim 9 wherein:

said first starting capacitor means comprises a capacitor having a capacitance value in the range of about 0.10 to about 0.20 microfarad; and said second starting capacitor means comprises a capacitor having a capacitance value in the range of about 0.15 to about 0.30 microfarad.

22. The invention of claim 21 wherein:

said first starting capacitor means comprises a capacitor having a capacitance value of about 0.10 microfarad; and said second starting capacitor means comprises a capacitor having a capacitance value of about 0.15 microfarad.

23. The invention of claim 15 wherein:

said first starting capacitor means comprises a capacitor having a capacitance value in the range of about 0.10 to about 0.20 microfarad; and said second starting capacitor means comprises a capacitor having a capacitance value in the range of about 0.15 to about 0.30 microfarad.

24. The invention of claim 23 wherein:

said first starting capacitor means comprises a capacitor having a capacitance value of about 0.10 microfarad; and said second starting capacitor means comprises a capacitor having a capacitance value of about 0.15 microfarad.

25. The invention of claim 6 wherein:

said first starting capacitor means comprises a starting capacitor having one terminal thereof connected to a selected terminal of said first pair of terminals of said first set of terminals and having the other terminal of said first starting capacitor connected to a selected one of said second pair of terminals of said second set of terminals; and said second starting capacitor means comprises a starting capacitor having one terminal thereof connected to a selected terminal of said first pair of terminals of said second set of terminals and having the other terminal of said second starting capacitor connected to a selected one of said second pair of terminals of said second set of terminals.

26. The invention of claim 25 wherein:

the ratio of said second predetermined open circuit voltage across said first and second secondary circuit output terminals to the total lamp operating voltage of three low energy, gas discharge lamps is in the range of about 1.10 to about 1.25.

27. The invention of claim 26 wherein:

said first starting capacitor means comprises a first capacitor having a first predetermined capacitance value; said second starting capacitor means comprises a second capacitor having a second predetermined capacitance value; and said first predetermined capacitance value is in the range of about one-third to about three-fourths of said second predetermined capacitance value.

28. The invention of claim 27 wherein:

said second predetermined open circuit voltage is in the range of about 265 to about 300 volts RMS; and said total lamp operating voltage is approximately 240 volts RMS.

29. The invention of claim 27 wherein:

said first starting capacitor means comprises a capacitor having a capacitance value in the range of about 0.10 to about 0.20 microfarad; and said second starting capacitor means comprises a capacitor having a capacitance value in the range of about 0.15 to about 0.30 microfarad.

30. The invention of claim 29 wherein:

said first starting capacitor means comprises a capacitor having a capacitance value of about 0.10 microfarad; and said second starting capacitor means comprises a capacitor having a capacitance value of about 0.15 microfarad.

31. A ballast circuit for operating three low energy, rapid start gas discharge lamps comprising:

autotransformer means comprising primary winding means having a pair of input terminal means for connection to a source of a.c. power and having a first secondary circuit output terminal connected thereto and secondary winding means connected to said primary winding means and having a second secondary circuit output terminal connected thereto for converting an input electrical a.c. power signal of a first predetermined voltage received at said pair of input terminal means to an output secondary circuit electrical a.c. signal of a second predetermined open circuit voltage output at said first and second secondary circuit output terminals;

power capacitor means for controlling the power factor and current level of said output signal;

a plurality of sets of lamp terminal means for connecting respective ones of said three low energy, gas discharge lamps each having a predetermined operating voltage in electrical series with said power capacitor means;

first starting capacitor means connected to respective ones of said terminal means for bypassing a combination of a first one of said sets of lamp terminal means and a second one of said sets of lamp terminal means; and comprising a first capacitor having a first predetermined capacitance value; and second starting capacitor means connected to respective ones of said terminal means for bypassing one of said first or said second sets of lamp terminal means and comprising a second capacitor having a second predetermined capacitance value; wherein said first predetermined capacitance value is in the range of about one-third to about three-fourths of said second predetermined capacitance value.

32. The invention of claim 31 wherein said power capacitor means comprises:

a power capacitor having one terminal thereof connected to said second secondary circuit output terminal and the other terminal of said power capacitor connected electrically to a selected one of said lamp terminal means.

33. The invention of claim 32 wherein said plurality of sets of lamp terminal means comprises:

a first set of lamp terminal means comprising two pairs of lamp terminals for connection respectively to cathodes disposed at the respective ends of a first one of said lamps; a first terminal of a first pair of said terminals being connected to said other terminal of said power capacitor;

a second set of lamp terminal means comprising two pairs of lamp terminals for connection respectively to cathodes disposed at the respective ends of a second one of said lamps; a selected first pair of said terminals of said second set being connected electrically to respective ones of a second pair of terminals of said first set; and a third set of lamp terminal means comprising two pairs of lamp terminals for connection respectively to cathodes disposed at the respective ends of a third one of said lamps; a selected first pair of said terminals of said third set being connected electrically to respective ones of a second pair of terminals of said second set and a selected terminal of a second pair of said terminals of said third set being connected electrically to said first secondary circuit output terminal.

34. The invention of claim 33 wherein:

said first starting capacitor means comprises a starting capacitor having one terminal thereof connected to a selected terminal of said first pair of terminals of said first set of terminals and having the other terminal of said first starting capacitor connected to a selected one of said second pair of terminals of said second set of terminals; and said second starting capacitor means comprises a starting capacitor having one terminal thereof connected to said selected terminal of said first pair of terminals of said first set of terminals and having the other terminal of said second starting capacitor connected to a selected one of said second pair of terminals of said first set of terminals.

35. The invention of claim 34 wherein:

said first starting capacitor means comprises a capacitor having a capacitance value in the range of about 0.10 to about 0.20 microfarad; and said second starting capacitor means comprises a capacitor having a capacitance value in the range of about 0.15 to about 0.30 microfarad.

36. The invention of claim 35 wherein:

said first starting capacitor means comprises a capacitor having a capacitance value of about 0.10 microfarad; and said second starting capacitor means comprising a capacitor having a capacitance value of about 0.15 microfarad.

37. The invention of claim 33 wherein:

said first starting capacitor means comprises a starting capacitor having one terminal thereof connected to a selected terminal of said first pair of terminals of said first set of terminals and having the other terminal of said first starting capacitor connected to a selected one of said second pair of terminals of said second set of terminals; and said second starting capacitor means comprises a starting capacitor having one terminal thereof connected to a selected terminal of said first pair of terminals of said second set of terminals and having the other terminal of said second starting capacitor connected to a selected one of said second pair of terminals of said second set of terminals.

38. The invention of claim 37 wherein:

said first starting capacitor means comprises a capacitor having a capacitance value in the range of about 0.10 to about 0.20 microfarad; and said second starting capacitor means comprises a capacitor having a capacitance value in the range of about 0.15 to about 0.30 microfarad.

39. The invention of claim 38 wherein:

said first starting capacitor means comprises a capacitor having a capacitance value of about 0.10 microfarad; and said second starting capacitor means comprises a capacitor having a capacitance value of about 0.15 microfarad.

* * * * *